United States Patent [19]

Maineult et al.

[11] Patent Number: 5,066,839

[45] Date of Patent: Nov. 19, 1991

[54] HIGH OR MEDIUM TENSION CIRCUIT BREAKER

[75] Inventors: Jean Maineult, Ceyzeriat; Raymond Pluveau, Macon, both of France

[73] Assignee: GEC Alsthom SA, Paris, France

[21] Appl. No.: 462,362

[22] Filed: Jan. 9, 1990

[30] Foreign Application Priority Data

Jan. 10, 1989 [FR] France ..... 89 00215

[51] Int. Cl.[5] ..... H01H 33/10; H01H 33/74

[52] U.S. Cl. ..... 200/144 R; 200/147 R; 200/147 B; 200/148 C

[58] Field of Search ..... 200/147 R, 147 B, 148 C, 200/144 C, 144 R

[56] References Cited

U.S. PATENT DOCUMENTS

| | | | |
|---|---|---|---|
| 2,362,798 | 11/1944 | Bold | 200/148 C |
| 2,757,261 | 7/1956 | Lingal et al. | 200/148 C |
| 2,847,540 | 8/1958 | Pfeiffer et al. | 200/147 B X |
| 2,945,109 | 7/1960 | Fehling | 200/147 R |
| 3,137,779 | 6/1964 | Latour | 200/147 B X |
| 3,139,503 | 6/1964 | Latour | 200/147 B X |
| 4,229,630 | 10/1980 | Wafer et al. | 200/147 R X |

FOREIGN PATENT DOCUMENTS

| | | | |
|---|---|---|---|
| 587110 | 10/1933 | Fed. Rep. of Germany | 200/148 C |
| 568967 | 4/1945 | United Kingdom | 200/148 C |

*Primary Examiner*—J. R. Scott

*Attorney, Agent, or Firm*—Sughrue, Mion, Zinn, Macpeak & Seas

[57] ABSTRACT

A medium or high tension circuit breaker comprising a shell filled with a dielectric gas under pressure and containing: a fixed main contact, a moving main contact, a fixed arcing contact, and a moving arcing contact between which an arc is established during contact separation. The arc within the circuit breaker is split up into a large number of elementary arcs, with each elementary arc being established between two metal plates.

9 Claims, 9 Drawing Sheets

HIGH OR MEDIUM TENSION CIRCUIT BREAKER

The present invention relates to a high or medium tension circuit breaker.

BACKGROUND OF THE INVENTION

Currents at high and medium tension are commonly interrupted by means of circuit breakers in which the interruption chamber is filled with a dielectric gas such as sulfur hexafluoride ($SF_6$).

At the moment the contacts open, the arc which develops between the contacts is subjected to a violent blast of compressed gas, thereby ensuring that the arc is extinguished at the next zero crossing of the current.

Such circuit breakers are expensive to construct because they must include means for compressing the blast gas and means for storing drive energy, sometimes in considerable quantities.

An aim of the invention is to provide a circuit breaker which does not require a gas compression device and which requires very low operating energy.

The interrupting principle used in the circuit breaker of the invention consists in establishing an arc tension which is greater than the network tension.

This principle is already used at low tension with air-filled current interrupting chambers. However the principle is not directly applicable to medium or high tension since the dielectric performance of air is inadequate and its deionization time constant is too long to allow a restoration voltage to develop, and the arc is restruck after each zero crossing of the current to be interrupted.

Attempts have therefore been made to use $SF_6$ gas whose good dielectric performance and low deionization time constant should allow voltage to be restored easily after interrupting the current.

However, a difficulty arises in using $SF_6$ due to the fact that arcing tensions in $SF_6$ are much lower than arcing tensions in air and at medium and high tension it is difficult, (and industrially impossible) to create sufficient arcing tension in $SF_6$ merely by stretching the arc.

This difficulty is solved by the present invention by using metal plates to split up the initial arc into a very high number of elementary arcs. The arcing tension of each elementary arc is due to voltage drops at the roots of the arcs and lies between 20 volts and 40 volts depending on the nature of the metal.

Another aim of the invention is to provide a medium or high tension current-limiting circuit breaker which opens automatically under the effect of a short-circuit current, thereby serving to limit the peak value of the short-circuit current to values which are equivalent to or less than the values obtained using current-limiting fuses.

SUMMARY OF THE INVENTION

The present invention provides a medium or high tension circuit breaker comprising a shell filled with a dielectric gas under pressure and containing: a fixed main contact, a moving main contact, a fixed arcing contact, and a moving arcing contact between which an arc is established during contact separation, wherein the circuit breaker includes means for splitting up the arc into a large number of elementary arcs, with each elementary arc being established between two metal plates.

Preferred numbers of plates as a function of nominal tension are as follows:

for a nominal tension of 12 kV, 300 to 900 plates;

for a nominal tension of 24 kV, 600 to 1400 plates; and for a nominal tension of 36 kV, 900 to 1800 plates.

In a particular embodiment of the invention the circuit breaker includes means for displacing the arc and giving it the shape of a solenoid.

BRIEF DESCRIPTION OF THE DRAWINGS

Embodiments of the invention are described by way of example with reference to the accompanying drawings, in which.

DETAILED DESCRIPTION

Figure 1:
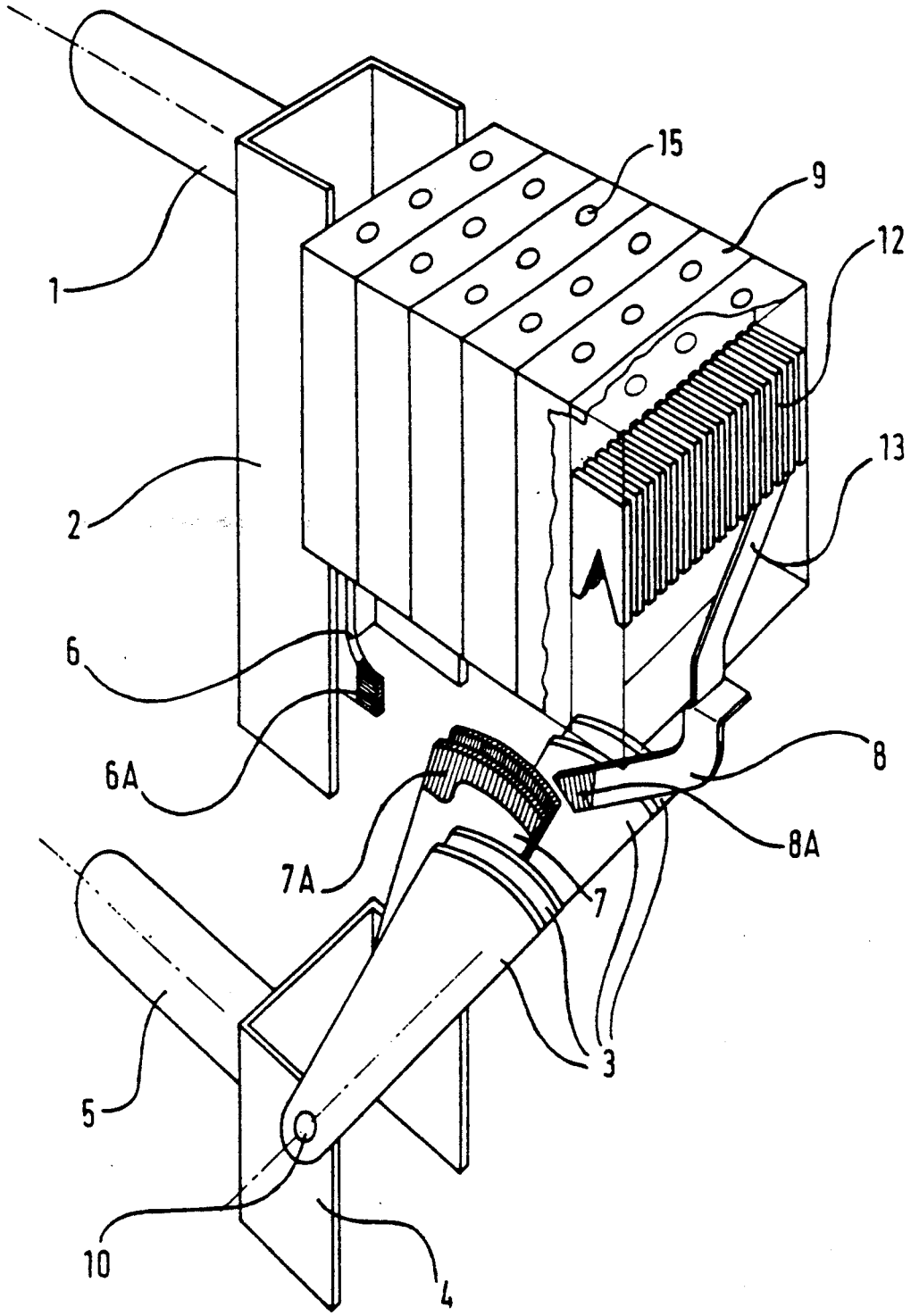
FIG. 1 is a diagrammatic perspective view of the active portion of a first embodiment of a circuit breaker in accordance with the invention.

FIG. 1 is a diagrammatic view of the inside of a circuit breaker.

The outer shell of the circuit breaker is not shown. The shell is filled with a dielectric gas such as sulfur hexafluoride, at a pressure of a few bars.

The circuit breaker comprises a permanent circuit and an interrupting circuit.

The permanent current circuit comprises feedthroughs 1 and 5 that feed current through the shell (not shown), a top fixed contact 2 constituted by a conducting channel section bar, and a bottom fixed contact 4 likewise constituted by a conducting channel section bar. Blades 3 rotate with a shaft 10 and are driven by a conventional device such as a crank arrangement (not shown).

The blades are associated with conventional means (not shown) for ensuring adequate contact pressure.

The interrupting circuit comprises in part a fixed arc-striking horn 6 terminated by a contact tab 6A made of a high melting point material such as a tungsten alloy.

Two current-interrupting blades 7 are protected by respective tips 7A of high melting point material. These blades rotate with the shaft 10 and are driven simultaneously with the blades 3, but they are angularly offset a little therefrom such that the contacts 6 and 7 separate after the contacts 2 and 3 have separated.

An arc-striking horn 8 is protected by a tip 8A; and the interrupting circuit also includes a current interrupting chamber 9.

Figure 2:
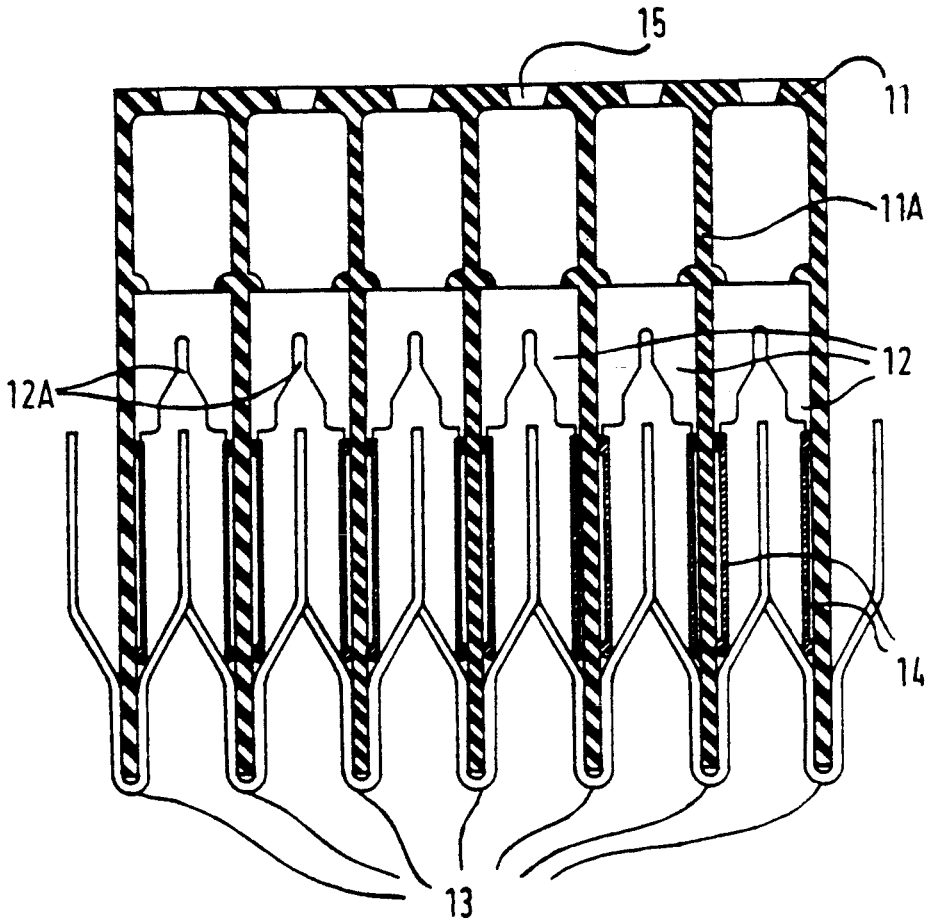
FIG. 2 is a cross-section through the current interrupting chamber of the circuit breaker.
Figure 5:
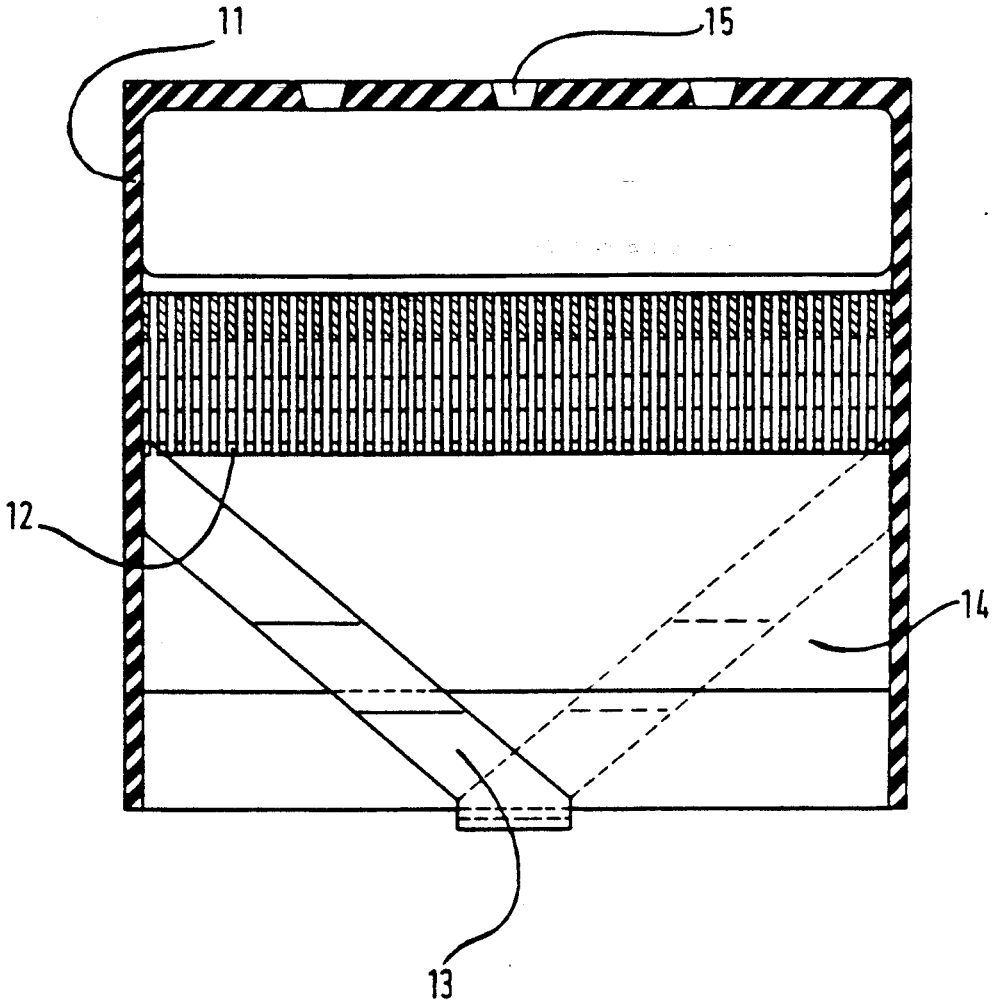
FIG. 5 is a longitudinal section view.

The interrupting chamber is described with reference to FIG. 1 as a perspective view; FIG. 2 as a section on a plane perpendicular to the shaft 10; and FIG. 5 in cross section.

The interrupting chamber comprises a box 11 made of plastic material.

The box comprises partitions 11A separating the chamber into a plurality of compartments. The box may either be a one-piece item or be constituted by a stack of identical pieces, if such construction facilitates assembling its internal parts.

The top of the box has holes 15 for evacuating the gases given off by the arc.

Each of the compartments contains a plurality of metal plates 12 disposed parallel to each other and parallel to a line passing through the contacts.

Each metal plate 12 has a notch 12*a* for increasing the speed with which the arc rises by concentrating the magnetic field of the current.

The plates are made of magnetic material and are between 0.8 mm and 2 mm thick, and they are spaced apart by gaps of 0.8 mm to 1.5 mm.

Figure 3A:
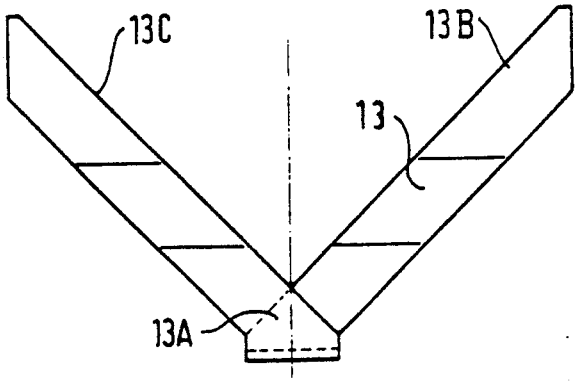
FIGS. 3A and 3B are respectively a front view and a side view of an electrode interconnecting two compartments of the chamber.
Figure 3B:
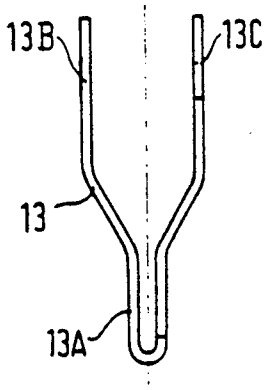

Metal electrodes 13 (FIGS. 3A and 3B) including a U-shaped portion 13A are placed astride each of the partitions 11A between pairs of adjacent compartments.

Each of these electrodes has two wings 13B and 13C which occupy respective ones of the adjacent compartments.

The wings are at about 90° to each other. The wings are plane and their planes lie perpendicular to the planes of the plates in the respective compartments.

Arc-resistant ceramic partitions 14 may optionally be mounted to protect the box 11 in high power circuit breakers.

An operation is performed as follows.

Figure 4:
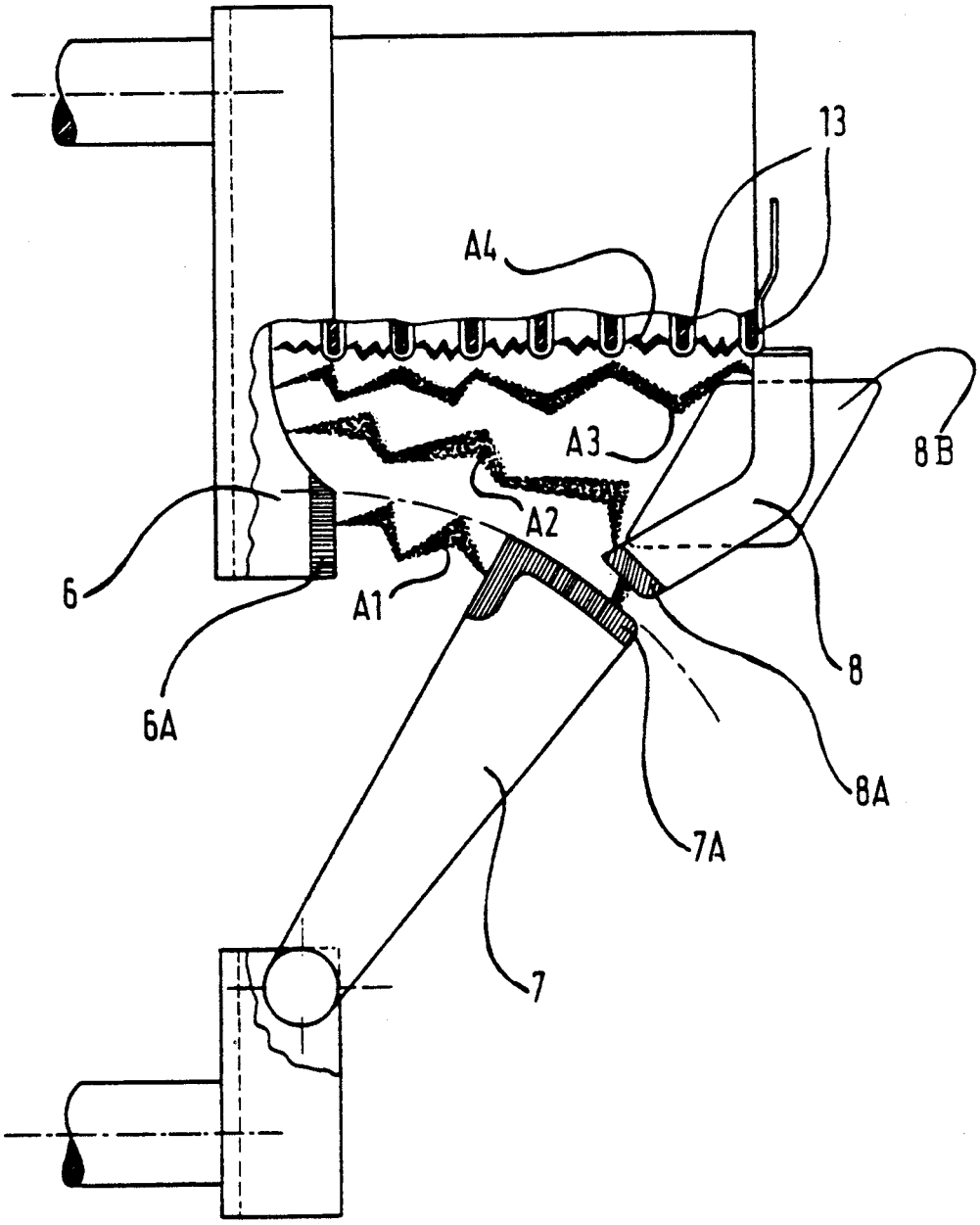
FIG. 4 is a diagram showing how the arc moves during a current-interrupting operation.

Under drive from an external mechanism, the blades 3 pivot and separate from fixed contact 2. Current then passes via the tab 6 and the blade 7. As it continues to pivot, the blade 7 moves away from the tab 6. The arc is struck at A1 FIG. 4, between the tips 6A and 7A. Under the effect of the magnetic field created by the current loop, the arc moves to A2 so as to be struck between the horns 6 and 8. Conventional devices such as blast windings (not shown) having the short-circuit current flowing therethrough, or magnetic sheets such as 8B placed around the electrodes 6 and 8 may be used for increasing the magnetic field acting on the arc. The arc stretches, and at A3 it reaches the entrance to the interruption chamber. On the inter-compartment electrodes 13 it splits into elementary arcs A4. Each of the A4 arc roots moves along one of the electrodes 13. Each arc A4 therefore stretches and pivots through 90° establishing a new current loop with the two wings of the electrodes 13. Since each of the arcs A4 moves identically, the current loops as a whole are connected in series and create a solenoid. The magnetic field produced by the solenoid forces the arcs A4 in between the metal plates 12, with each arc A4 then subdividing into a large number of arcs, thereby suddenly increasing the arc tension, limiting the interrupter current, and extinguishing that current.

The arc stabilizes between the plates because of the small distance between the metal plates 12 and of the cushion of gas created at the top of each compartment in the chamber 9 by the energy produced by the arc itself.

Pressure is released through the calibrated holes 15.

The top portions of the plates may be made insulating in order to prevent the roots of the arcs from moving further either by depositing a layer of plastic insulating material, or else by depositing a layer of ceramic material (e.g. alumina).

The set of blades 3 and 7 continue to rotate and reaches the open position of the circuit breaker as required by its voltage-withstanding characteristics.

For closing the circuit breaker, the blade 7 makes contact the blade 6 and causes current to be established via the tips 6A and 7A. Thereafter the blades 3 make contact with the contact 2.

A high or medium tension current-limiting circuit breaker can be made using the above-described principle suitable for limiting short-circuit current peaks to values which are equivalent or less than those that can be obtained using current-limiting fuses.

Figure 6:
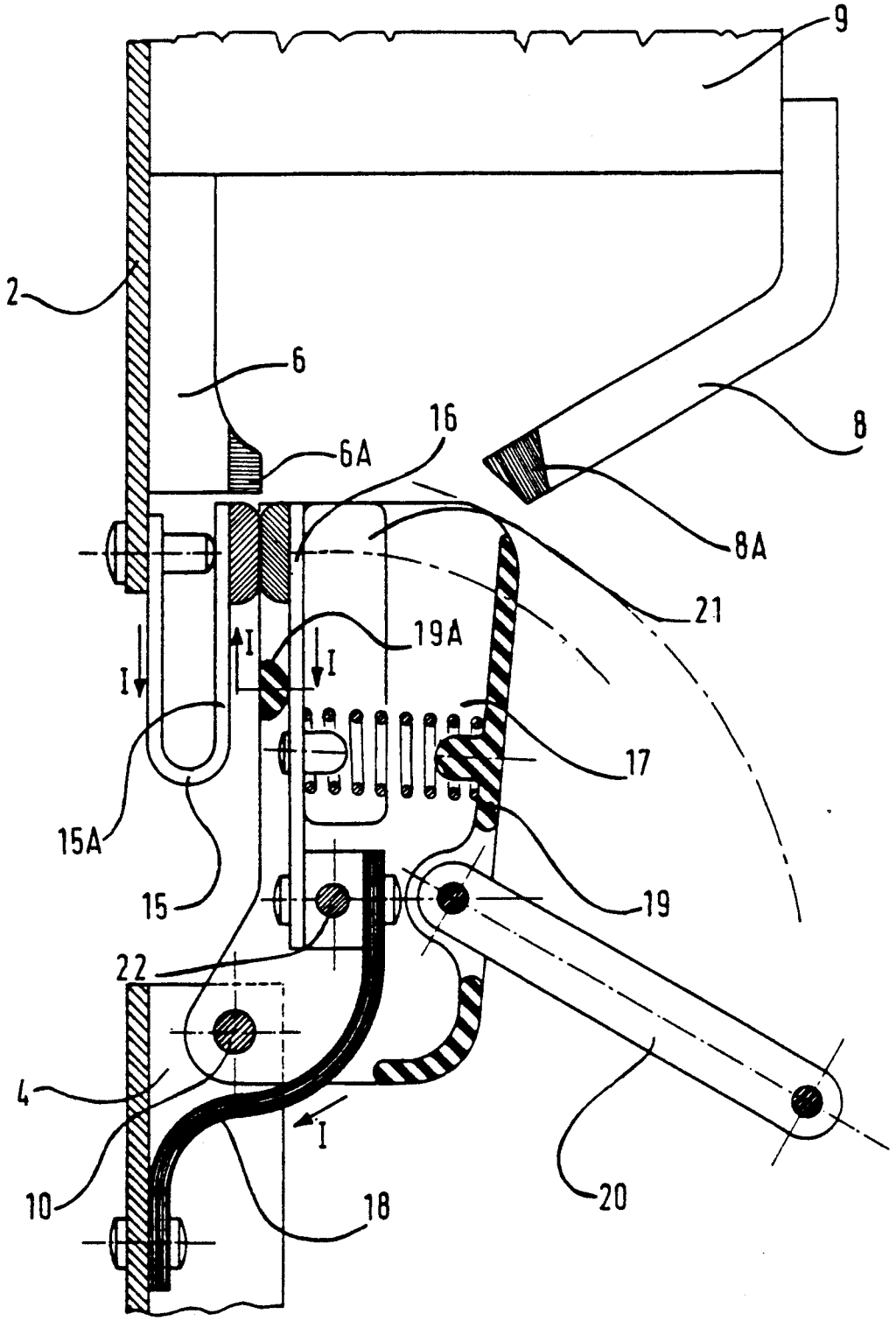
FIG. 6 is a diagrammatic view of the central portion of a current-limiting circuit breaker based on the principle of the invention.

FIG. 6 shows one such current-limiting circuit breaker inside its shell filled with dielectric gas.

The above-described moving contact is replaced by a repulsion type of contact. The other components of the circuit breaker, namely the feedthroughs 1 and 5, the contacts 4 and 6, the current interrupting chamber 9, having the electrode 8, the mechanical transmission, and the shell, are all unchanged.

The repulsion moving contact comprises a contact 15 fixed to the contact 2 and having a rectilinear portion 15A.

A contact carrier 19 made of molded insulating material is driven to rotate about the shaft 10 by a connecting-rod 20.

A contact 16 situated on the contact carrier 19 and moveable about an axis 22 is connected to the contact 4 by a deformable braid 18.

A spring 17 bearing against the items 19 and 16 imparts sufficient contact pressure to allow the permanent current to pass.

Metal plates 21 are fixed on the contact carrier 19. Their purpose is to increase the magnetic field on the contact 16 in order to increase the repulsion effect. When a large value short-circuit current appears, very large electrodynamic forces appear between the contact 16 and the contact 15.

The contact 16 is repelled violently.

The arc which appears between contacts 15 and 16 switches almost instantaneously to the electrodes 6 and 8. The remainder of the current-interrupting process then continues in the way described above.

Figure 7:
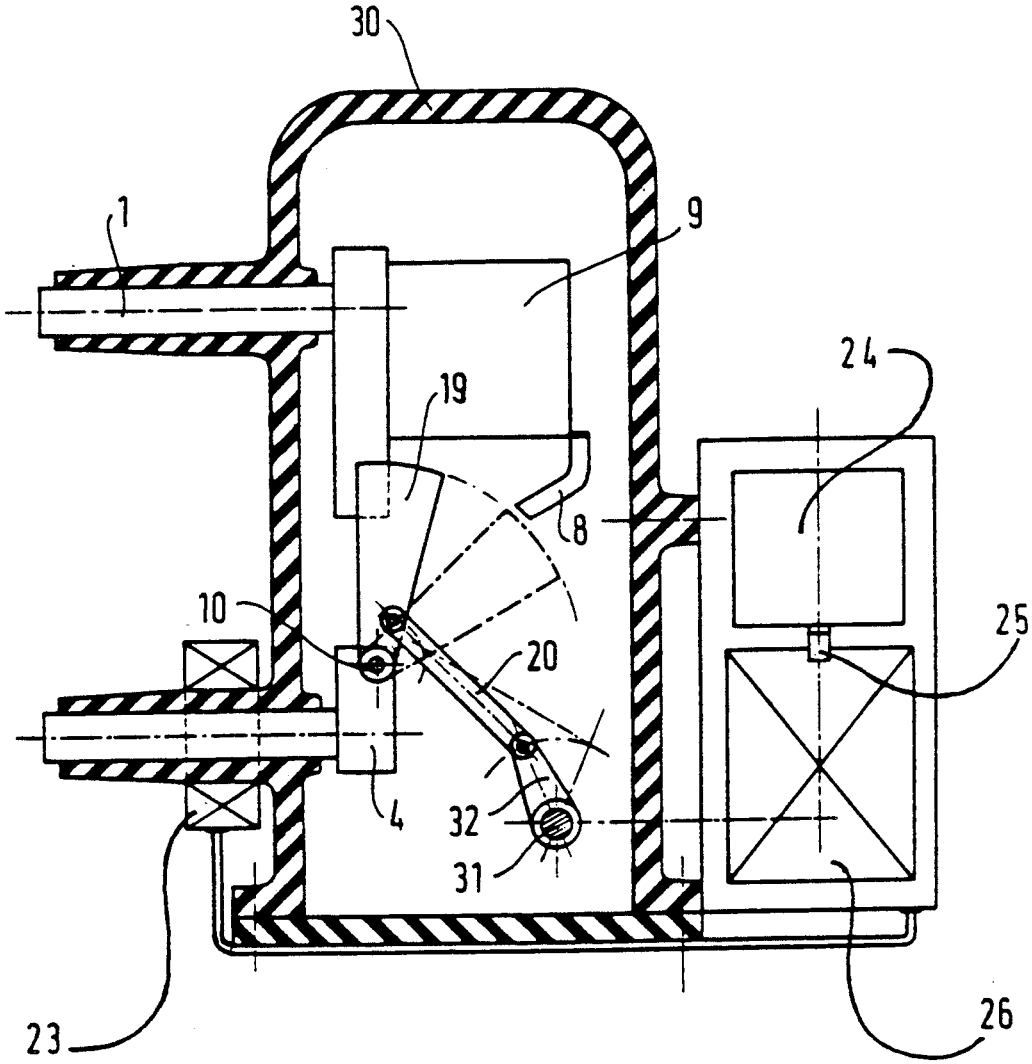
FIG. 7 is a diagrammatic section through the current-limiting circuit breaker of FIG. 6.

FIG. 7 is a section through the entire current-limiting circuit breaker including its insulating shell 30.

Low tension toruses 23 (FIG. 7) situated around the feedthroughs in the shell sense a sudden change in current, and via an electronic relay 24 and a low energy level striker 25, as conventional items, they cause control means 26 to give a circuit breaking instruction. This drives a shaft 31, thereby rotating a crank 32 and moving the connecting-rod 20 so as to move the fingers 16 and the contact carriers 19 to an open position before the fingers 16 move back into contact with the element 15 under the effect of the spring 17. The contact 16 stops against an abutment 19*a* fixed to the contact carrier 19.

The assembly comprising the circuit breaker, the low tension toruses, the electronic relay, and the control means constitutes a self-contained protection assembly. The electronic relay also serves to detect intermediate fault currents, and to establish a thermal image of the apparatus under protection.

This assembly is particularly well suited to protecting medium tension transformers in the public distribution network, and also to protecting high power motors.

Figure 8:
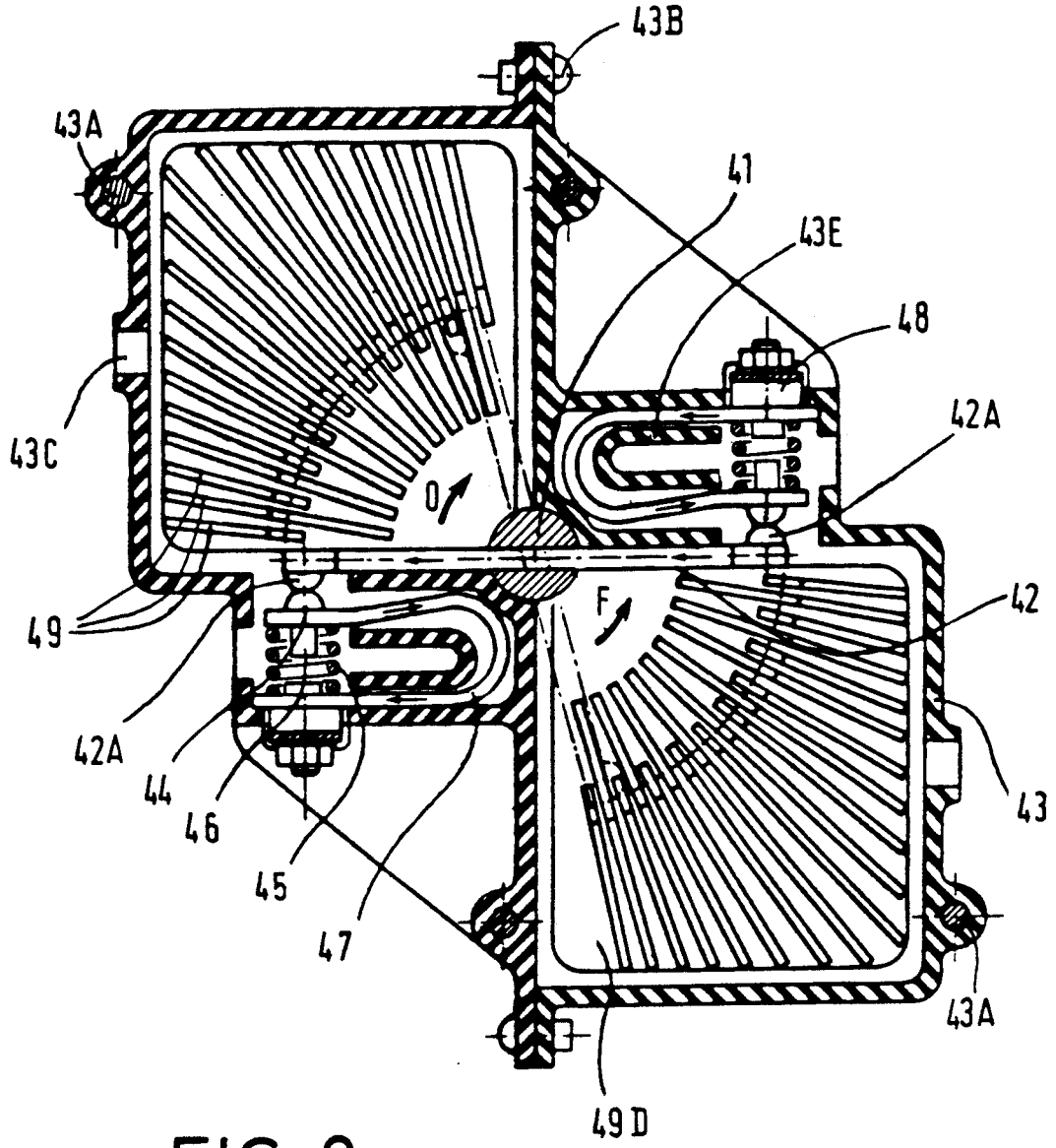
FIG. 8 is a cross-section through a variant circuit breaker.

FIG. 8 is a cross-section through the current interrupting chamber of a variant circuit breaker of the invention.

This variant is particularly suitable for circuit breakers having low nominal current, such as circuit breakers used for controlling and protecting motors at tensions of less than 12 kV and at nominal currents of less than 250 A, which functions are currently performed by associations of contactors and fuses, and circuit breakers used for controlling and protecting transformers in the public distribution network operating at tensions of less than 36 kV with nominal currents of less than 150 A, which functions are currently performed by associations of circuit breakers and fuses.

The current interruption chamber shown in FIG. 8 is placed in a single- three-pole metal or insulating enclosure (not shown) filled with a gas having good dielectric performance, e.g. sulfur hexafluoride.

The interrupting chamber includes an insulating shaft 41 rotatable to drive a series of contact strips 42 simultaneously. Each strip has a contact tab 42A at its ends.

The interrupting chamber comprises an insulating box made up of a plurality of elementary boxes 43 held together by ties **43*a*. Each elementary box comprises two molded elements held together by fasteners 43B**.

Each box has calibrated holes 43C for putting the inside of the box into communication with the outside.

The section of the box shown in FIG. 8 is in the form of a two rectangles which are symmetrically disposed about the shaft. Each box has an opening for receiving a strip. Metal plates 49 are disposed inside each of the portions of the box in a radial fan-like disposition, with the planes of the plates including the axis of the shaft 41. The plates in two adjacent boxes are coplanar in pairs.

Figure 9:
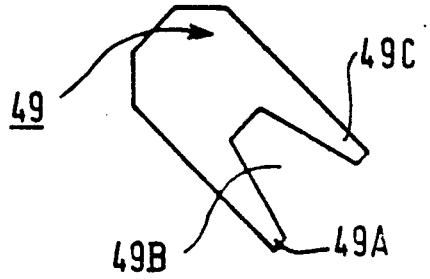
FIG. 9 shows one of the plates fitted to the current interrupting chamber.

Each plate FIG. 9 has two prongs 49A and 49C on either side of a gap 49B through which the strip 42 passes.

In order to increase the number of plates, short plates and long plates alternate, with the plates being fixed together by side cheeks 49D.

The fixed contact has contact tabs 44 fitted with respective springs 45 for ensuring contact pressure and guided by respective guides 46, and they also include respective deformable conducting connections 47 and connection strips 48 for connection to the adjacent box.

Figure 11:
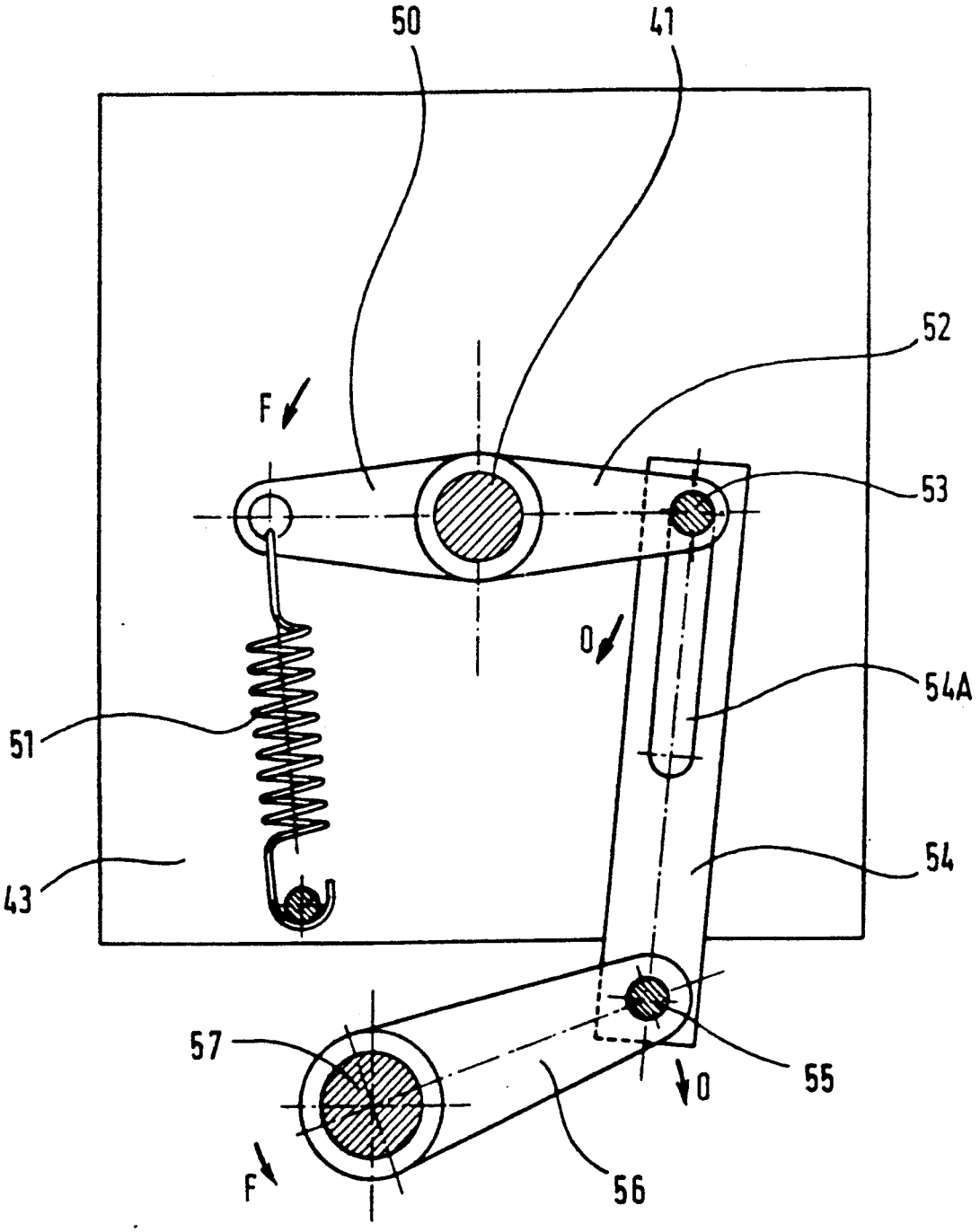
FIG. 11 is a view of the circuit breaker drive means.

Reference is made to FIG. 11 where it is evident that at regular intervals defined by the twisting strength of the shaft 41 there are mechanical drive stages interposed between current interrupting boxes, each mechanical drive stage comprising a lever 50 fixed to the shaft 41, and a spring 51 attached both to the lever 50 and to the box 43.

The force delivered by the set of springs 51 is slightly greater than the sum of the contact forces defined by the springs 44, thereby maintaining the shaft 41 in position in abutment against the box 43.

In addition, the point where the spring 51 is fixed on the box 43 may be disposed in such a manner that when in the open position it maintains the shaft 41 in the open position by passing through a dead point.

The mechanical stage also includes in part, a lever 52 fixed to the shaft 41;

A connecting-rod 54 has a slot 54A of length suitable for enabling the shaft 41 to perform an opening operation even if the connecting-rod 54 does not move.

A crank 56 is hinged at 55 to the connecting-rod 54 and fixed to a shaft 57 connected to mechanical control means.

In order to accelerate the speed of rotation of the shaft 41, it is also possible to insert one or more accelerator stages.

Figure 10:
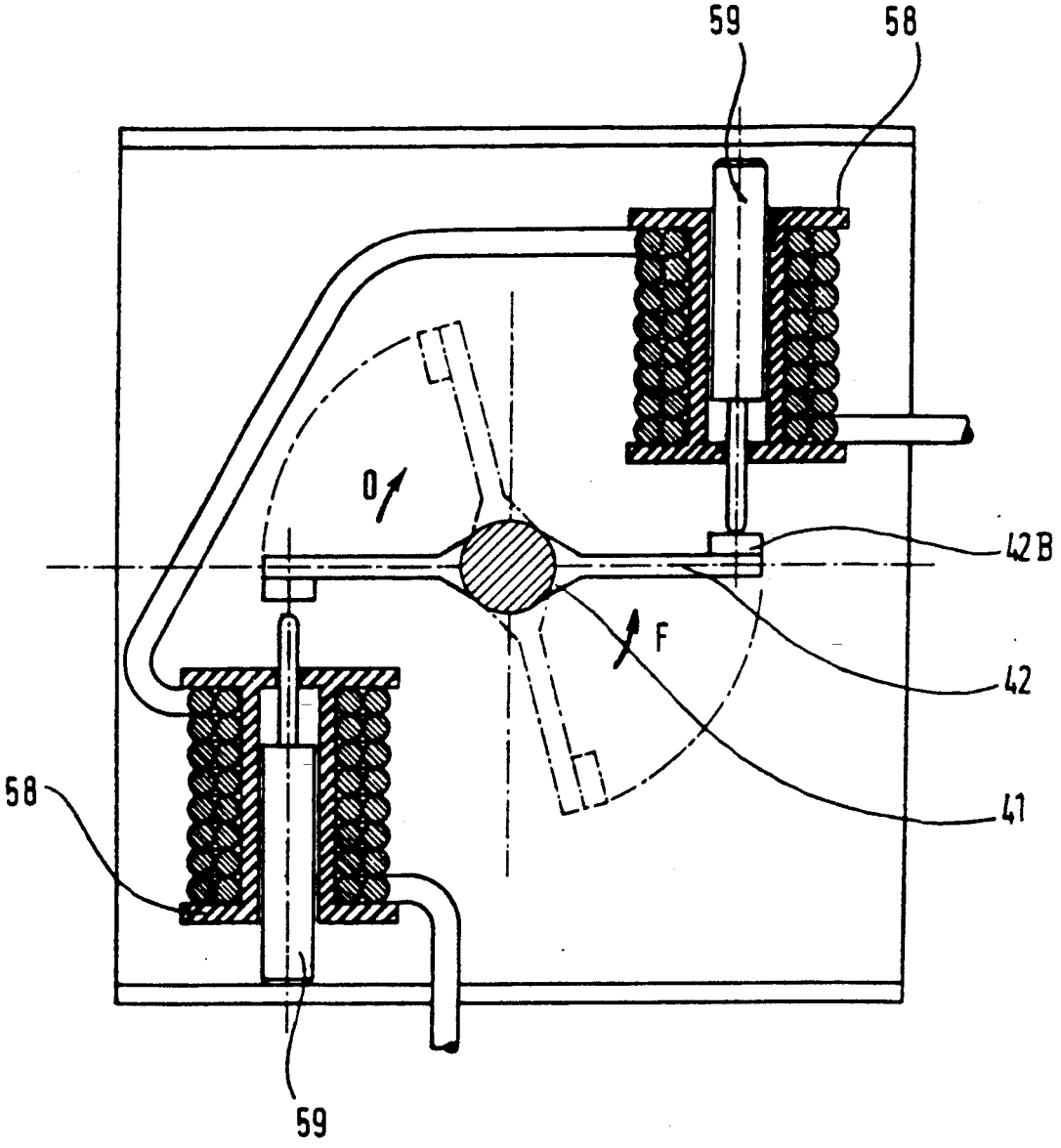
FIG. 10 is a cross-section through an accelerator stage.

Such an accelerator stage is shown in FIG. 10. On a strip 42 of the shaft 41, the contact tabs are replaced by elements 42B having high resistance to shock.

Two windings 58 provided with cores 59 are fed with the current and the cores 59 strike the elements 42B, thereby setting the shaft 41 rapidly into motion.

A complete interrupting chamber thus comprises a juxtaposition or stack of the three types of compartments described above, including interrupting stages, accelerator stages and mechanical drives stages.

This circuit breaker operates as follows.

In FIGS. 8, 10, and 11, the apparatus is shown in the closed position.

An opening instruction given by the mechanical control means causes the shaft 57 to rotate in the direction of arrow 0.

The shaft 41 is driven in the direction of arrow 0 by the connection rod 54. The arc which appears between the tabs **42*a* and 44 is stretched in front of the plates 49. Under the effect of the magnetic field set up by the conductor 47, the arc itself, and the strip 42, and as reinforced by the horns 42B, the arc moves in amongst the plates 49** and splits up into elementary arcs. The arc tension increases rapidly, thereby limiting current, bringing current and tension into phase, and finally extinguishing the current.

A close instruction given to the mechanical control means causes the shaft 57 to be rotated in the direction of arrow F.

Under the action of the springs 51, the shaft 41 is driven towards its closed position.

If a large short-circuit current occurs while the apparatus is closed or closing, the shaft 41 is rotated in the direction 0 under the action of electrodynamic forces acting between the conductors 47 and the strips 42. This motion is made possible regardless of the position or the motion of the shaft 57 by virtue of the slot 54A in the connecting-rod 54. The arc is then extinguished in the same way as during a voluntary opening operation.

An instruction given to the control means then rotates the shaft 57 to its open position, thereby maintaining the shaft 41 in its open position.

This instruction may be given by the elements such as sensors constituted by low tension toruses placed around the current feedthroughs or the lead-in cables of the protected element, and an electronic relay receiving information from the sensors and delivering a signal to a low energy level striker which releases the latch of the control means.

The electronic relay can also simulate a thermal image of the apparatus under protection.

The invention is applicable to medium and high tension circuit breakers.

We claim:

1. A medium or high tension circuit breaker comprising a shell filled with a dielectric gas under pressure and containing: a fixed main contact, a moving main contact, a fixed arcing contact, and a moving arcing contact, an interrupting chamber disposed adjacent to said fixed arcing contact and an arc being established during contact separation between said moving arcing contact and said fixed arcing contact, said arc interrupting chamber including a plurality of laterally spaced partitions forming a plurality of separate compartments for said interrupting chamber, means for splitting up the arc into a large number of elementary arcs comprising a plurality of spaced metal plates disposed parallel to each other in a plurality of compartments such that for each compartment, two partitions are parallel to each other and perpendicular to said plates positioned therein, said compartments being closed except over an arcing zone, and each partition being equipped with a metal electrode having a portion fitted astride each partition and having two unitary wings extending in respective ones of said adjacent compartments, said wings being planar and extending perpendicular to the plane of the plates in respective compartments, and said wings being at an angle of about 90° to each other.

2. A circuit breaker according to claim 1, wherein the circuit breaker has a nominal tension of 12 kV, and the number of plates lies in the range 300 to 900.

3. A circuit breaker according to claim 1, wherein the circuit breaker has a nominal tension of 24 kV, and the number of plates lies in the range 600 to 1400.

4. A circuit breaker according to claim 1, wherein the circuit breaker has a nominal tension of 36 kV, and the number of plates lies in the range 900 to 1800.

5. A circuit breaker according to claim 1, wherein the plates are made of magnetic material.

6. A circuit breaker according to claim 1, wherein the thickness of the plates lies in the range 0.8 mm to 2 mm.

7. A circuit breaker according to claim 1, wherein the width of the gaps between the plates lie in the range 0.8 mm to 1.5 mm.

8. A circuit breaker according to claim 1, wherein the partitions define walls of said compartments and are at least partially covered with a layer of refractory material.

9. A circuit breaker according to claim 1, wherein the interrupting chamber comprises a box provided with calibrated orifices allowing passage of dielectric gas from the interior of the arc interrupting chamber opposite to the arcing zone.

* * * * *